US007614475B2

(12) United States Patent
Askew

(10) Patent No.: US 7,614,475 B2
(45) Date of Patent: Nov. 10, 2009

(54) LONGITUDINAL STRINGER EXHAUST FLEX PIPE ASSEMBLY

(75) Inventor: Gerald W. Askew, Fort Wayne, IN (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 178 days.

(21) Appl. No.: 11/750,544

(22) Filed: May 18, 2007

(65) Prior Publication Data

US 2008/0283328 A1 Nov. 20, 2008

(51) Int. Cl.
*B60K 13/04* (2006.01)

(52) U.S. Cl. ..... 180/309; 180/296; 285/423

(58) Field of Classification Search ..... 180/309, 180/89.2, 296; 138/118, 119, 149, 135, 161, 138/156, 136; 285/148.19, 235, 288.4, 423, 285/226, 229, 137

See application file for complete search history.

(56) References Cited

U.S. PATENT DOCUMENTS

| | | | | | |
|---|---|---|---|---|---|
| 1,093,766 | A * | 4/1914 | Camppield | ..... | 138/156 |
| 1,299,884 | A * | 4/1919 | Webber | ..... | 138/115 |
| 1,913,390 | A * | 6/1933 | Hungerford | ..... | 138/135 |
| 2,240,210 | A * | 4/1941 | Dreyer | ..... | 138/134 |
| 2,420,153 | A * | 5/1947 | Sprenger et al. | ..... | 285/235 |
| 2,460,984 | A * | 2/1949 | Hill et al. | ..... | 285/233 |
| 2,628,111 | A * | 2/1953 | Smalline | ..... | 285/310 |
| 3,623,513 | A * | 11/1971 | Dinkelkamp | ..... | 138/114 |
| 3,628,572 | A * | 12/1971 | Shannon | ..... | 138/161 |
| 4,312,526 | A * | 1/1982 | Cassel | ..... | 285/419 |
| 5,228,479 | A * | 7/1993 | Thomas | ..... | 138/149 |
| 5,362,113 | A * | 11/1994 | Thomas | ..... | 285/288.4 |
| 5,601,893 | A * | 2/1997 | Strassel et al. | ..... | 138/118 |
| 5,647,358 | A * | 7/1997 | Vilasi | ..... | 138/156 |
| 6,102,446 | A | 8/2000 | Thomas | | |
| 6,155,303 | A | 12/2000 | Krawietz et al. | | |
| 6,247,500 | B1 * | 6/2001 | McMahon | ..... | 138/157 |
| 6,311,736 | B2 * | 11/2001 | Herman et al. | ..... | 138/135 |
| 6,315,332 | B1 | 11/2001 | Aschoff et al. | | |
| 6,612,342 | B2 | 9/2003 | Godel et al. | | |
| 6,843,516 | B2 * | 1/2005 | Bishop et al. | ..... | 285/420 |
| 6,983,768 | B1 * | 1/2006 | Vujic | ..... | 138/119 |

* cited by examiner

*Primary Examiner*—Hau V Phan
(74) *Attorney, Agent, or Firm*—Jeffrey P. Calfa; Mark C. Bach; Gerald W. Askew

(57) ABSTRACT

A longitudinal stringer type exhaust flex pipe assembly is provided having two end pieces and multiple interlaced interlocking longitudinal stringer elements forming a flexible cylinder. Every other longitudinal stringer element is affixed to each end piece, such that each stringer element is affixed to only one end piece. The stringer elements each have a male and a female interlocking feature that allows them to slide freely between each other while maintaining a relatively air-tight seal.

10 Claims, 10 Drawing Sheets

VEHICLE HAVING EXHAUST SYSTEM USING FLEX-PIPE

VEHICLE HAVING EXHAUST SYSTEM
USING FLEX-PIPE

EXHAUST SYSTEM HAVING FLEX-PIPE AND SHOWING RELATIVE MOVEMENT BETWEEN ENGINE AND CHASSIS

PRIOR ART BELLOWS-TYPE
EXHAUST FLEX PIPE

PRIOR ART COIL-TYPE
EXHAUST FLEX PIPE

LONGITUDINAL STRINGER TYPE
EXHAUST FLEX PIPE ASSEMBLY

SECTION VIEW THROUGH SECTION PLANE "A" OF LONGITUDINAL STRINGER EXHAUST FLEX PIPE ASSEMBLY

INDIVIDUAL LONGITUDINAL STRINGER ELEMENT

END PIECE

SECTION VIEW THROUGH SECTION PLANE C OF END PIECE

PARTIAL SECTION VIEW THROUGH SECTION PLANE B OF A LONGITUDINAL STRINGER TYPE EXHAUST FLEX PIPE ASSEMBLY

LONGITUDINAL STRINGER EXHAUST FLEX PIPE ASSEMBLY

DETAILED DESCRIPTION OF THE INVENTION

It is often necessary in the manufacture of a vehicle having an engine subject to vibrations and movement relative to the chassis of the vehicle to provide an exhaust flex pipe between the exhaust outlet of the engine and the remainder of the exhaust system. It is advantageous to make this exhaust flex pipe as compliant as possible in compression, extension, axial bending, and torsion.

Figure 1:
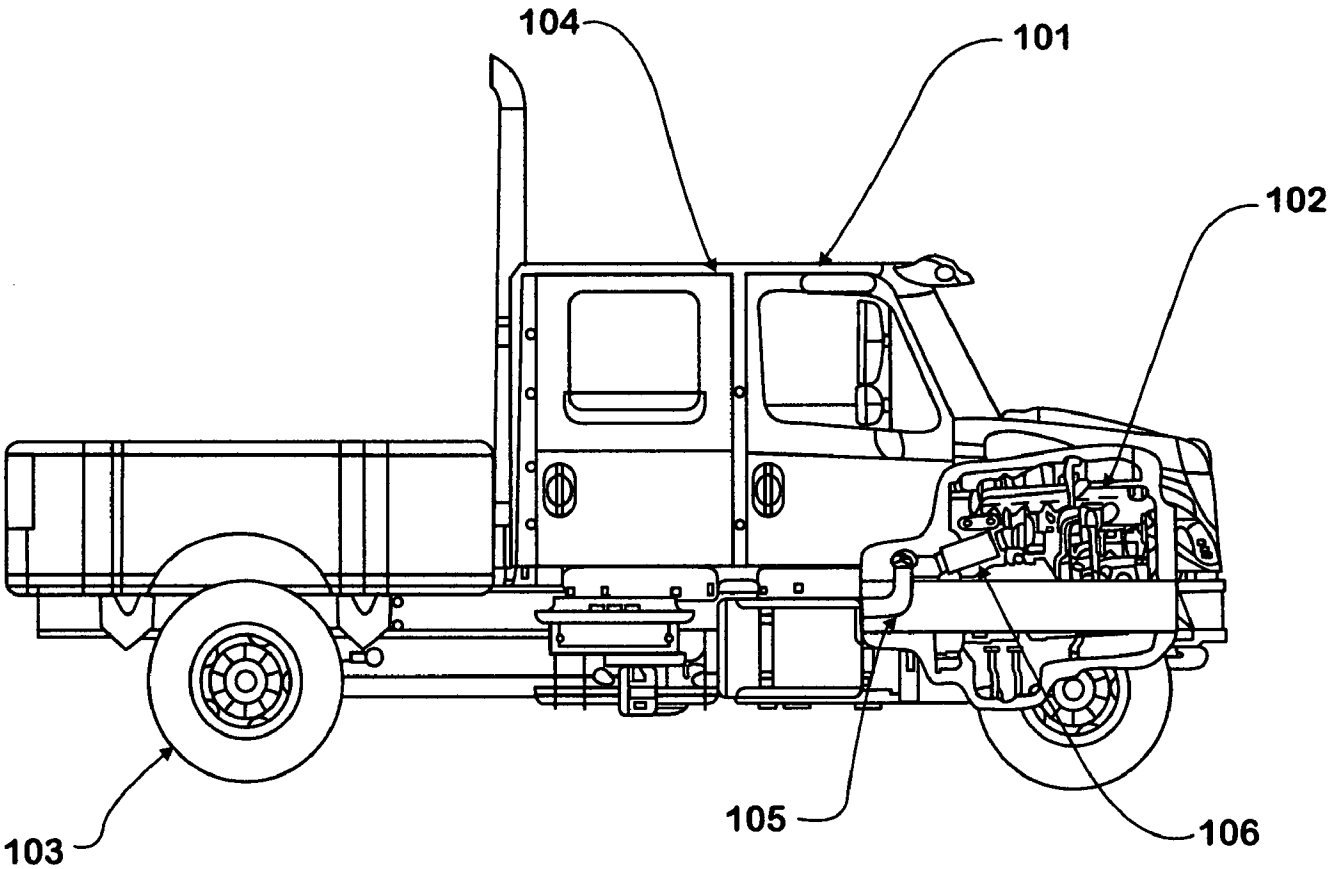
FIG. 1—Vehicle having an engine and an exhaust system incorporating a flex pipe.

FIG. 1 shows a vehicle 101 having an engine 102, a chassis 103, and a body 104. The engine 102 is connected to an exhaust system 105, by means of which exhaust system 105 exhaust generated by the engine 102 is conveyed safely away from occupants of the vehicle 101. Due to relative movement between the engine 102, the chassis 103, and the exhaust system 105, an exhaust flex pipe 106 is provided, typically at a location near the engine 102.

Figure 2:
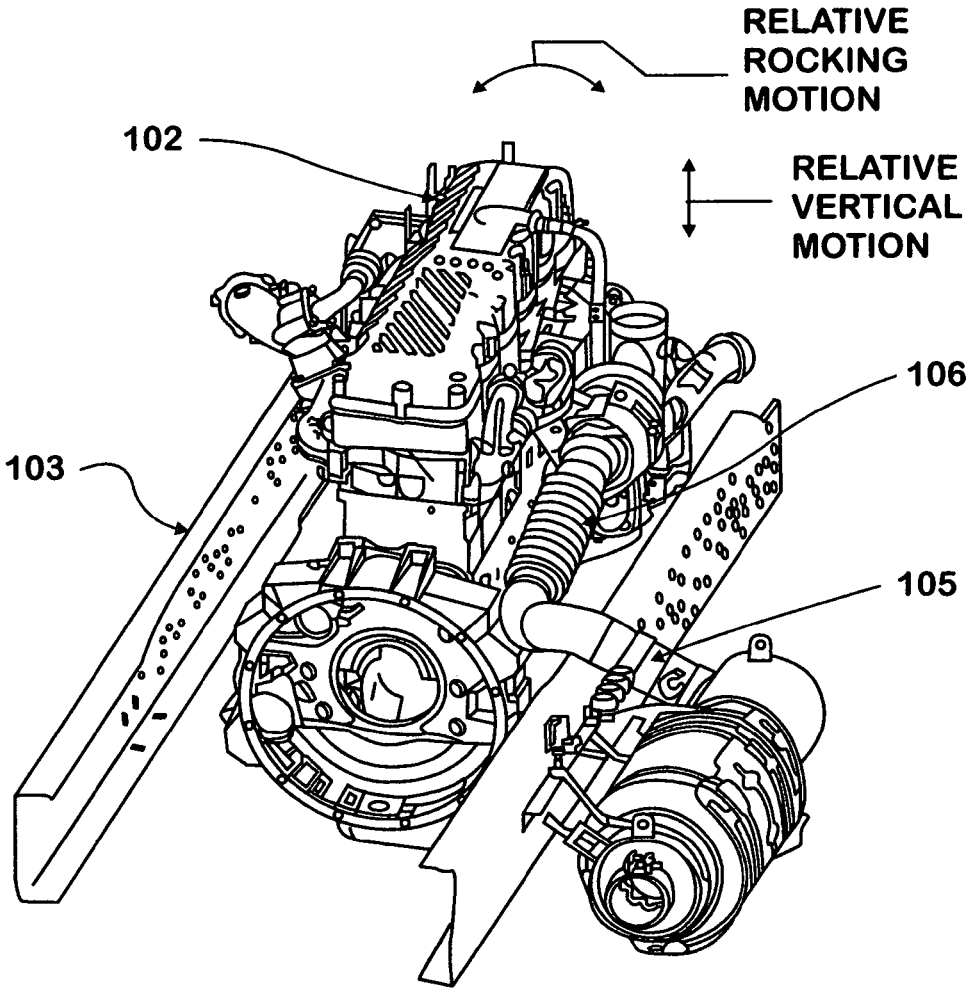
FIG. 2—Vehicle chassis and engine with an exhaust system and a flex pipe showing relative movement between the engine and chassis.

FIG. 2 shows an engine 102 in a chassis 103. The engine 102 is again connected to an exhaust system 105, which exhaust system 105 is provided with an exhaust flex pipe 106. Vertical motion and rocking motion of the engine 102 relative to the chassis 103 and exhaust system 105 is represented graphically in FIG. 2. The exhaust flex pipe 106 is provided to accommodate this relative motion.

Figure 3:
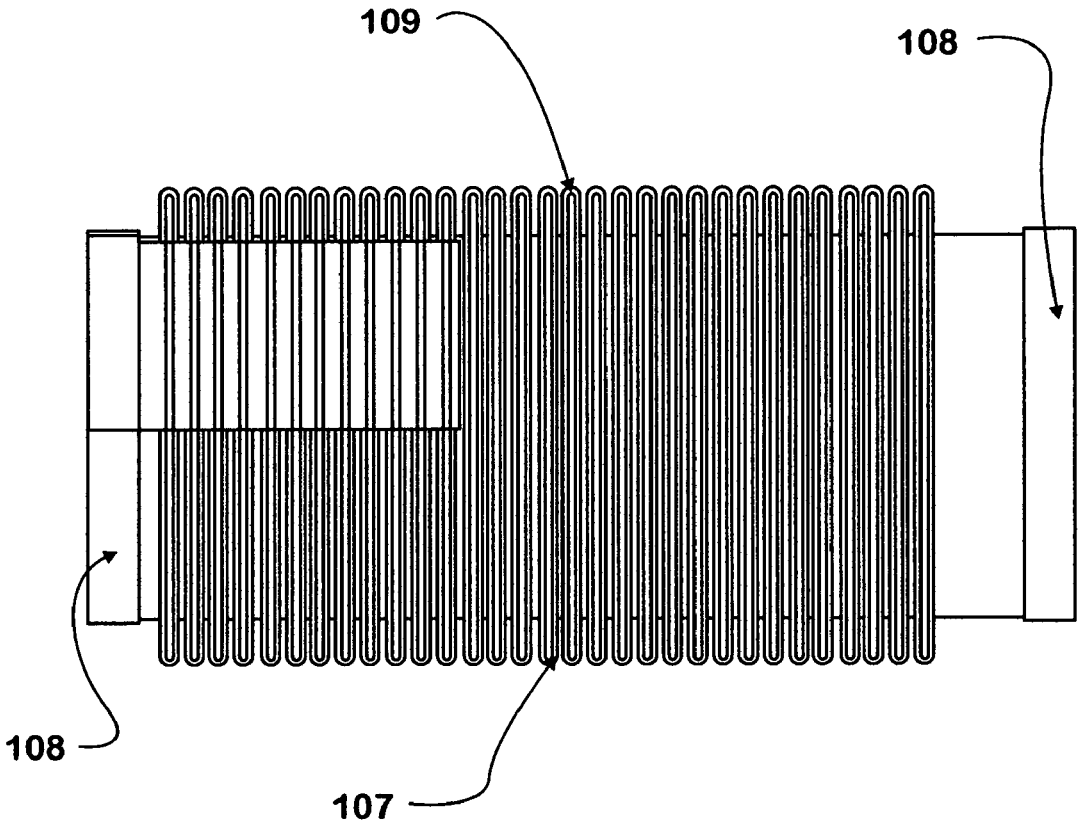
FIG. 3—Prior art bellows type flex pipe.

FIG. 3 shows a prior art bellows type exhaust flex pipe 107. The prior art bellows type exhaust flex pipe 107 is provided with multiple bellows 109 and two clamping sections 108, and is shown partially cut away, such that some of the multiple bellows 109 may be seen in cross section. The multiple bellows 109 allow for a certain amount of longitudinal extension, compression, and axial bending of the prior art bellows type exhaust flex pipe 107. Detrimentally to the performance of the prior art bellows type exhaust flex pipe 107, the multiple bellows 109 are only minimally torsionally compliant.

Figure 4:
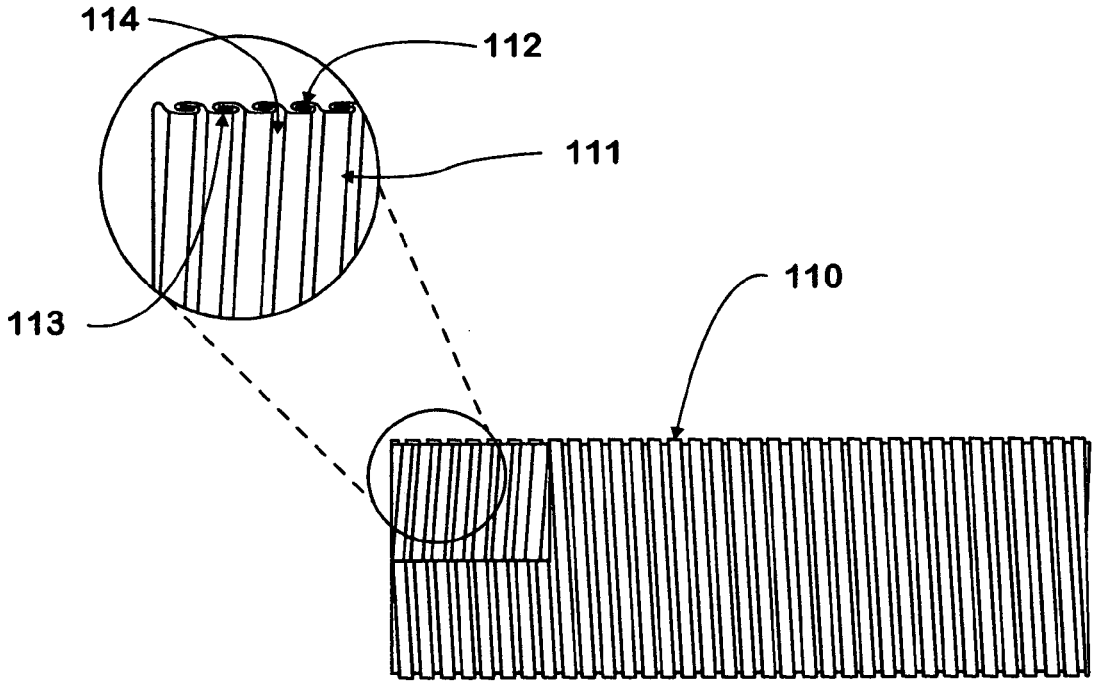
FIG. 4—Prior art coil type flex pipe.

FIG. 4 shows a prior art coil type exhaust flex pipe 110. The prior art coil type exhaust flex pipe 110 is formed from at least one continuous strip of flexible sheet metal formed into interlocking coils 111. The flexible interlocking formed sheet metal coils 111 are crimped one to the next such that the sliding crimped joints 112 are able to compress and extend longitudinally, and slide tangentially. In order to prevent leaks, the sliding crimped joints 112 have to be crimped tightly, yet not tightly enough to prevent relative motion.

Because of this, and because of the high ratio of width to length of the surfaces that are in sliding contact 113 within the sliding crimped joints 112, the overall compliance of the prior art coil type exhaust flex pipe 110 to axial bending or longitudinal extension or compression is limited. This is particularly true at relatively high frequencies, such as those that occur as a result of relative movement and vibration of the engine 102 (not shown). The problem is compounded when the gaps 114 between the sliding crimped joints 112 and the flexible interlocking formed sheet metal coils 111 become filled with carbon soot from the engine 102 (not shown).

Figure 5:
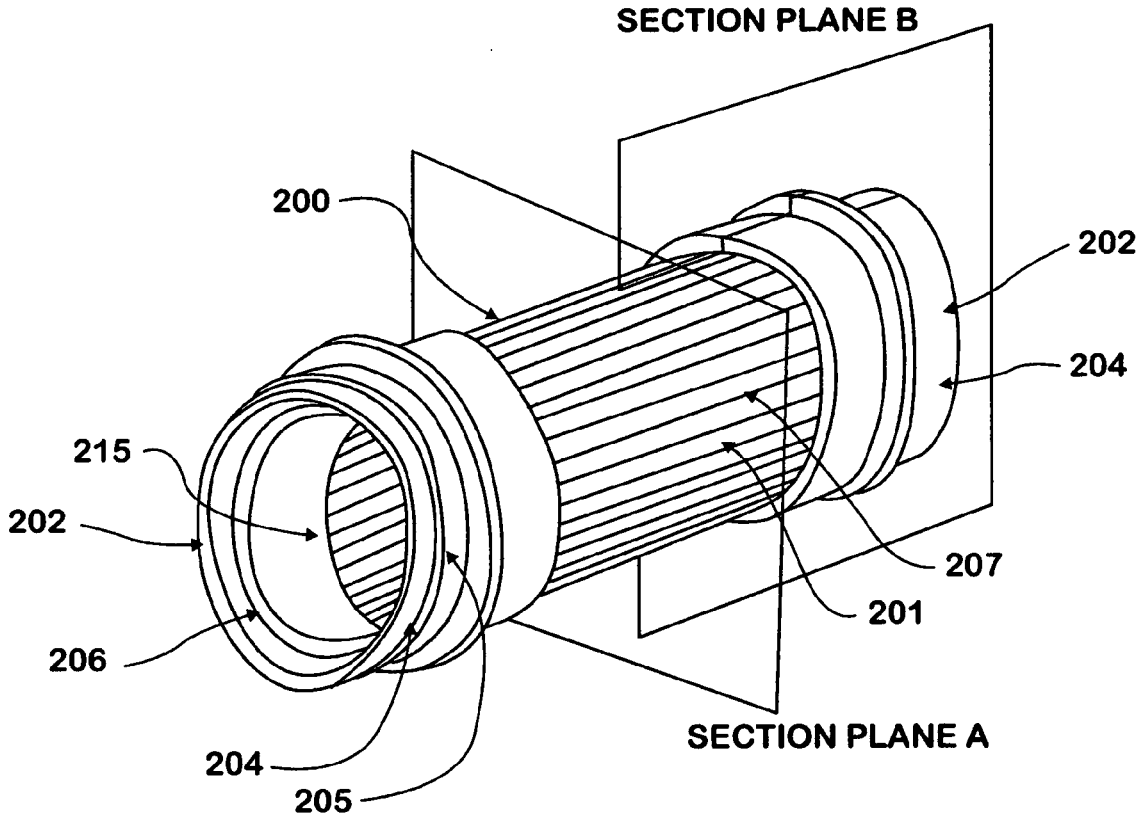
FIG. 5—Longitudinal stringer type flex pipe assembly embodiment of the present invention.

FIG. 5 shows a longitudinal stringer type exhaust flex pipe assembly 200. Interlocking longitudinal stringer elements 201 are interlaced to form a flexible cylinder 207. The ends of the interlocking longitudinal stringer elements 201 are inserted into annular cavities 203 (not visible) in longitudinal stringer type exhaust flex pipe end pieces 202. Alternating ends of the interlocking longitudinal stringer elements 201 are retained by a snap ring, bonded, keyed, welded, pinned, crimped, or otherwise affixed within the annular cavities 203 of each longitudinal stringer type exhaust flex pipe end piece 202. Each longitudinal stringer type exhaust flex pipe end piece 202 is provided with an exhaust passage 215 and an exhaust pipe attachment surface 204, and may also be provided with features such as an exhaust pipe retaining bead 205 or an exhaust pipe insertion stop 206. Two section planes, Section Plane A and Section Plane B, are illustrated for reference in subsequent figures.

Figure 6:
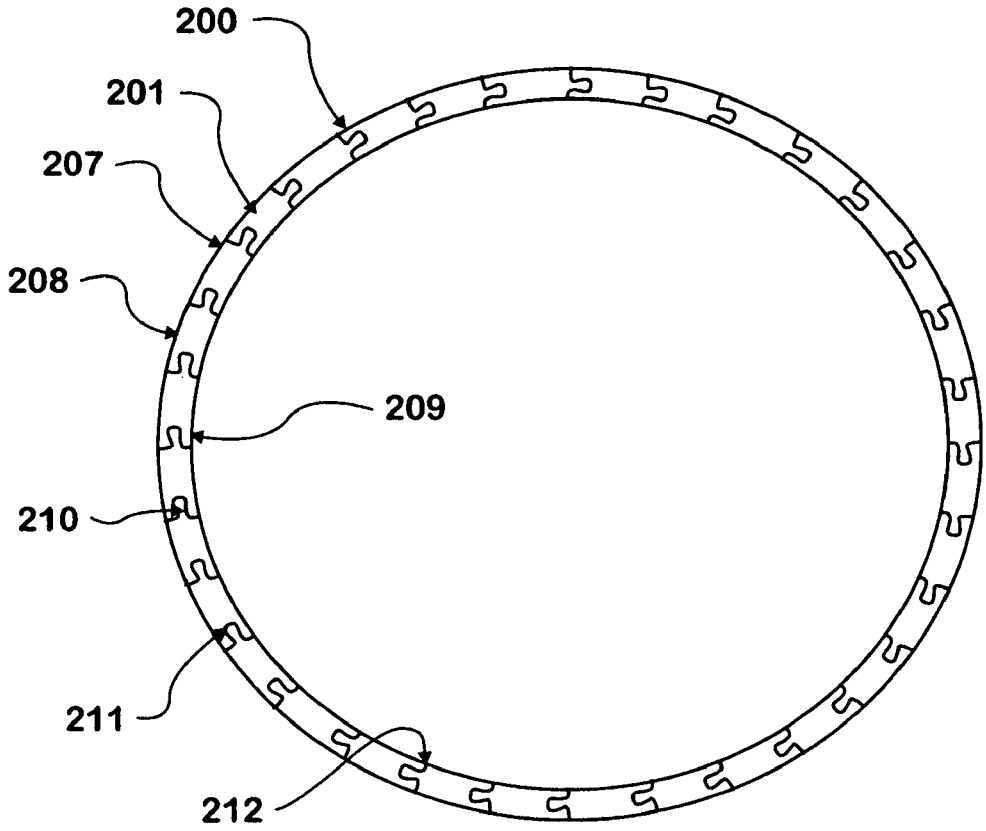
FIG. 6—Section view of longitudinal stringer type flex pipe assembly embodiment of the present invention.

FIG. 6 shows a section view of the longitudinal stringer type exhaust flex pipe assembly 200 taken through Section Plane A as shown in FIG. 5. Interlocking longitudinal stringer elements 201 are interlocked one to the next in a circular arrangement, thereby forming a flexible cylinder 207. Each of the interlocking longitudinal stringer elements 201 are provided with an interlocking longitudinal stringer element outer convex surface 208, an interlocking longitudinal stringer element inner concave surface 209, a male interlocking feature 210, a female interlocking feature 211, and mating sealing surfaces 212. The male interlocking features 210 and the female interlocking features 211 are such that the interlocking longitudinal stringer elements 201 are able to slide freely in the longitudinal direction. Interlocking longitudinal stringer elements 201 having alternate shapes may be used. In the same way, male interlocking features 210 and female interlocking features 211 of alternate design may be used. Thirty-two interlocking longitudinal stringer elements 201 are shown for the sake of illustration, though the actual number used may vary. A greater number of interlocking longitudinal stringer elements 201 would be advantageous to the flexibility of the longitudinal stringer type exhaust flex pipe assembly 200, due to the decreased lateral bending moment of the narrower interlocking longitudinal stringer elements 201.

Figure 7:
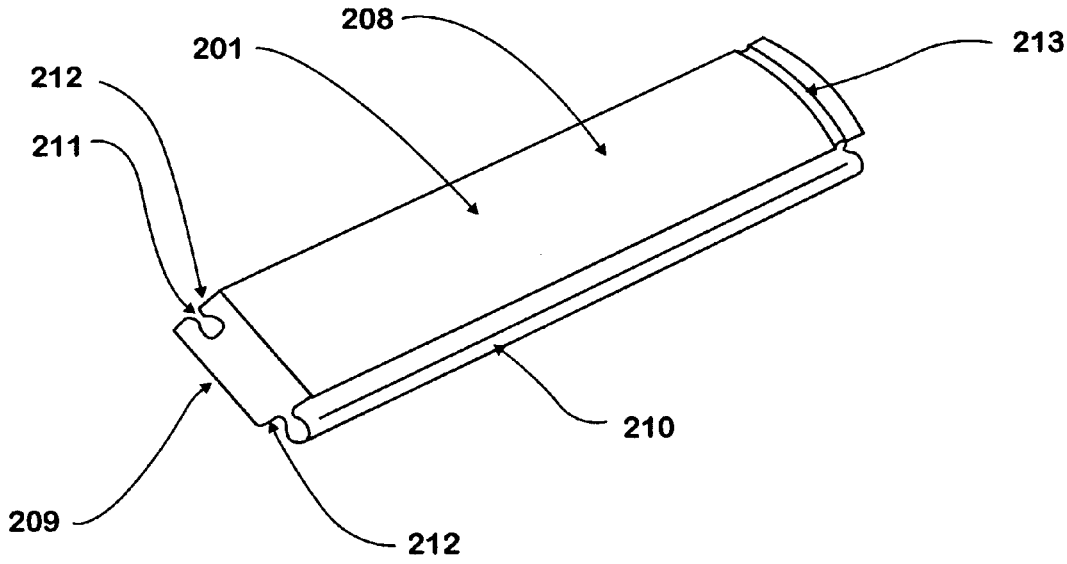
FIG. 7—Individual longitudinal stringer.

FIG. 7 shows an individual interlocking longitudinal stringer element 201 in a somewhat foreshortened view. The individual interlocking longitudinal stringer element 201 is again provided with an interlocking longitudinal stringer element outer convex surface 208, an interlocking longitudinal stringer element inner concave surface 209, a male interlocking feature 210, a female interlocking feature 211, and mating sealing surfaces 212. The individual interlocking longitudinal stringer element 201 may be further provided with an interlocking longitudinal stringer element retaining feature 213, such as a snap-ring groove as shown, or a hole for a roll-pin.

Figure 8:
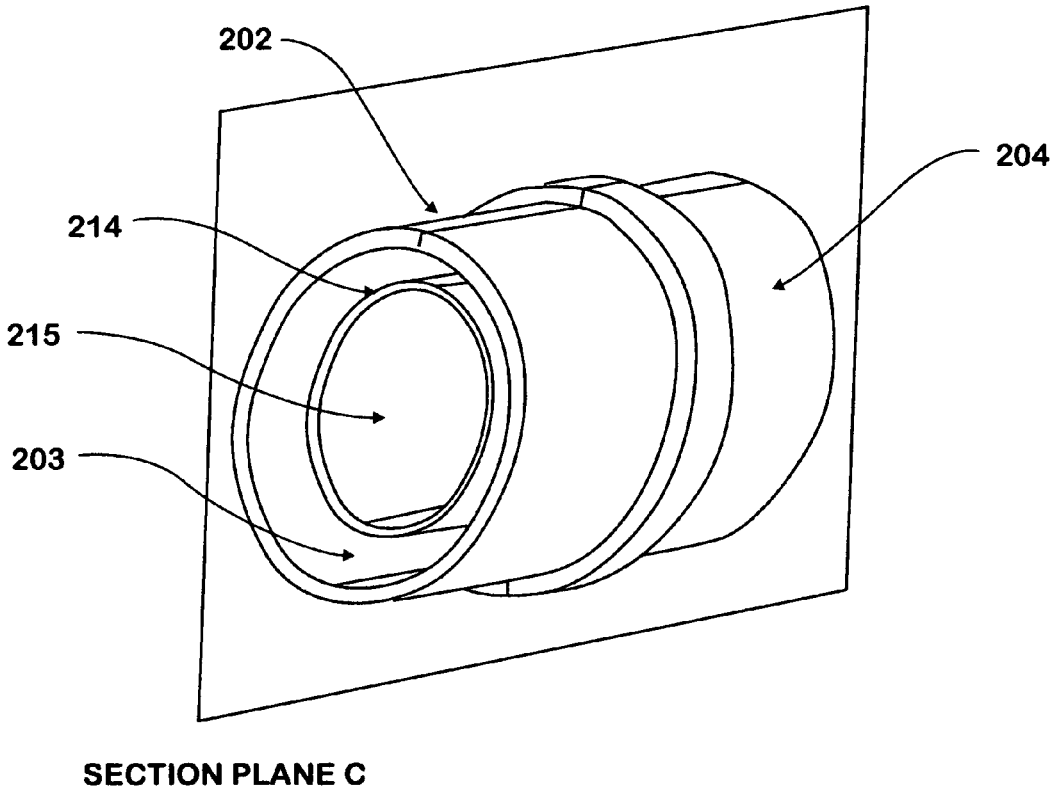
FIG. 8—Isometric view of longitudinal stringer type flex pipe end piece.

FIG. 8 shows an isometric view of a longitudinal stringer type exhaust flex pipe end piece 202. The longitudinal stringer type exhaust flex pipe end piece 202 is generally tubular to accommodate the passage of exhaust. It has an annular cavity 203 separated from the exhaust passage 215 by an inner reinforcement sleeve 214. The longitudinal stringer type exhaust flex pipe end piece 202 is also provided with an exhaust pipe attachment surface 204. A section plane, Section Plane C, is illustrated for reference in subsequent figures.

Figure 9:
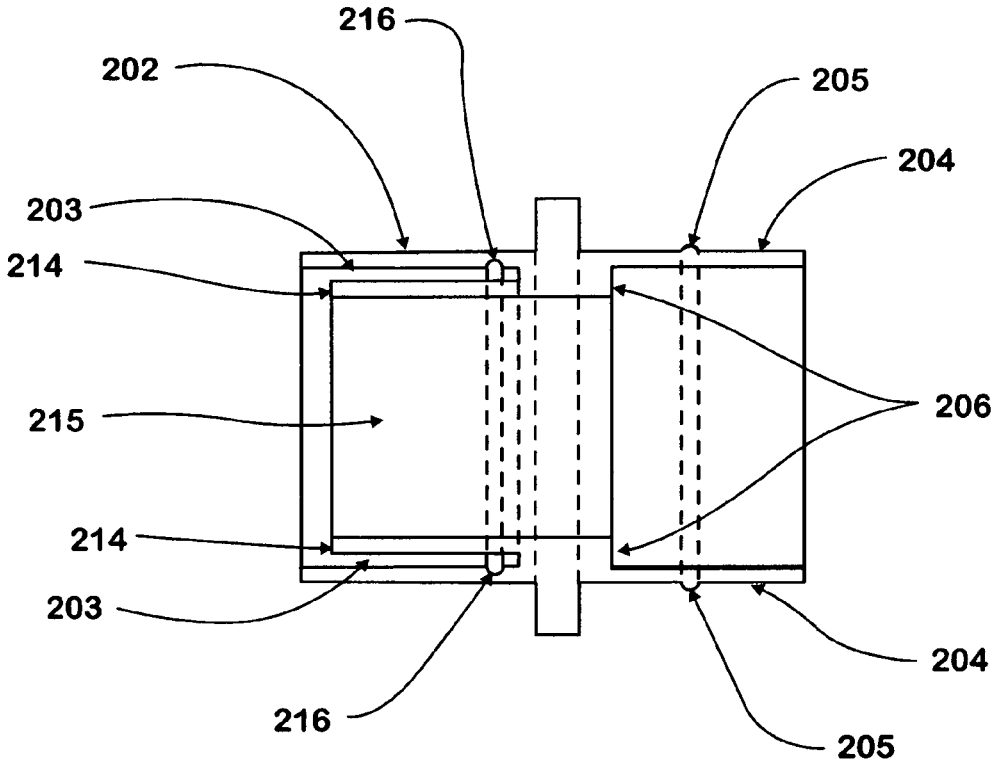
FIG. 9—Section view of longitudinal stringer type flex pipe end piece.

FIG. 9 shows a section view of a longitudinal stringer type exhaust flex pipe end piece 202 taken through Section Plane C as shown in FIG. 8. The longitudinal stringer type exhaust flex pipe end piece 202 is again generally tubular, having an exhaust passage 215. An annular cavity 203 is separated from the exhaust passage 215 by an inner reinforcement sleeve 214, which annular cavity 203 is intended to receive the flexible cylinder 207 (not shown) comprised of interlocking longitudinal stringer elements 201 (not shown). Near the bottom of the annular cavity 203 is an end piece longitudinal stringer retaining feature 216. The end piece longitudinal stringer retaining feature 216 is shown in FIG. 9 as a snap-ring groove, but it could take the form of a series of holes for roll-pins, a keyway, or other such retaining feature. The longitudinal stringer type exhaust flex pipe end piece 202 is again provided with an exhaust pipe attachment surface 204, and may be provided an exhaust pipe retaining bead 205 or an exhaust pipe insertion stop 206.

Figure 10:
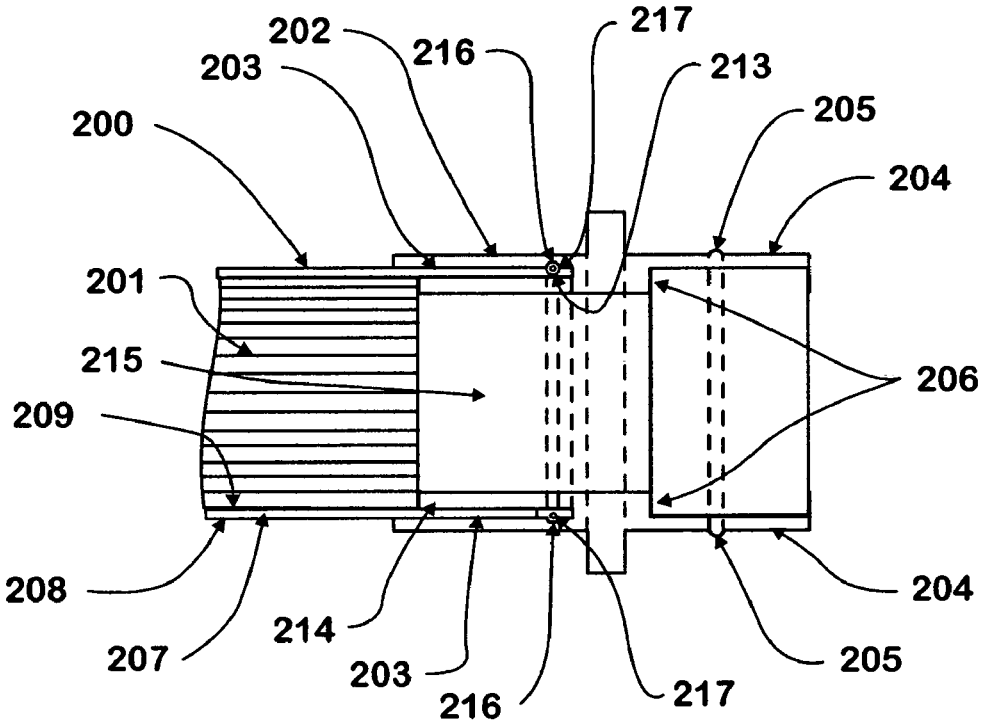
FIG. 10—Section view of portion of longitudinal stringer type flex pipe assembly.

FIG. 10 shows a section view of a portion of a longitudinal stringer type exhaust flex pipe assembly 200 taken through Section Plane B as shown in FIG. 5. Only one of the two longitudinal stringer type exhaust flex pipe end pieces 202 is shown, which longitudinal stringer type exhaust flex pipe end piece 202 is again provided with an exhaust pipe attachment surface 204, an exhaust pipe retaining bead 205, and an insertion stop 206. The flexible cylinder 207, formed from multiple interlocking longitudinal stringer elements 201, is inserted into the annular cavity 203 of the longitudinal stringer type exhaust flex pipe end piece 202. Every other interlocking longitudinal stringer element 201 is possessed of an interlocking longitudinal stringer element retaining feature 213 at the end nearest the longitudinal stringer type exhaust flex pipe end piece 202 shown. These interlocking longitudinal stringer element retaining features 213 are engaged to a snap ring 217, which snap ring 217 is in turn engaged to the end piece longitudinal stringer retaining feature 216. The alternate interlocking longitudinal stringer elements 201 are possessed of interlocking longitudinal stringer element retaining features 213 at their far ends, such that they engage to a snap ring 217 and end piece longitudinal stringer retaining feature 216 in the other longitudinal stringer type exhaust flex pipe end piece 202 (not shown). The interlocking longitudinal stringer element inner concave surface 209 of each interlocking longitudinal stringer element 201 is of the same curvature as the outer surface of the inner reinforcement sleeve 214. In the same way, the interlocking longitudinal stringer element outer convex surface 208 of each interlocking longitudinal stringer element 201 is of the same curvature as the inner surface of the outer wall of the annular cavity 203. In this way, and due to the mating sealing surfaces 212 and the tight fit of the male interlocking feature 210 and female interlocking feature 211 of the interlocking longitudinal stringer elements 201 (see FIG. 6), the air tightness of the exhaust passage 215 is preserved. Alternate contours of the outer surface and the inner surface of the interlocking longitudinal stringer elements 201 may be used, such as both inner surface and outer surface being flat, or both inner surface and outer surface being convex, provided that mating contours upon the inner reinforcement sleeve 214 and upon the inner surface of the outer wall of the annular cavity 203 are provided. Such a configuration may even be advantageous, as it may prevent overall rotation of the flexible cylinder 207 within the annular cavities 203 of the longitudinal stringer type exhaust flex pipe end pieces 202. The inner reinforcement sleeve 214 may also have a slight inwards taper near its end towards the interlocking longitudinal stringer elements 201 in order to provide stress relief. In the same way, the longitudinal stringer type exhaust flex pipe end piece 202 itself may be slightly belled outward near its end towards the interlocking longitudinal stringer elements 201, in order to provide stress relief. Because of the low ratio of width to length of the surfaces that are in sliding contact, and because there are no gaps to fill with carbon soot from the engine 102 (not shown), the interlaced interlocking longitudinal stringer elements 201 are able to slide easily relative to one another. The result of this is that the longitudinal stringer type exhaust flex pipe assembly 200 is compliant in compression, extension, axial bending, torsion, and translation.

While specific embodiments have been described in detail in the foregoing detailed description and illustrated in the accompanying drawings, those with ordinary skill in the art will appreciate that various permutations of the invention are possible without departing from the teachings disclosed herein. Accordingly, the particular arrangements disclosed are meant to be illustrative only and not limiting as to the scope of the invention, which is to be given the full breadth of the appended claims and any and all equivalents thereof. Other advantages to a vehicle equipped with a longitudinal stringer type exhaust flex pipe assembly may also be inherent in the invention, without having been described above.

I claim:

1. A longitudinal stringer type exhaust flex pipe assembly, comprising:

two end pieces, said two end pieces being connected by a flexible cylinder, said flexible cylinder being formed of multiple interlaced interlocking longitudinal stringer elements, each of said multiple interlaced interlocking longitudinal stringer elements being affixed to only one of said two end pieces, such that every other interlaced interlocking longitudinal stringer element is affixed to each end piece, each of said multiple interlaced interlocking longitudinal stringer elements having a first longitudinal interlocking feature and a second longitudinal interlocking feature, said first longitudinal interlocking feature of each of said interlocking longitudinal stringer element engaging said second longitudinal interlocking feature of the adjacent interlocking longitudinal stringer element, such that each of said interlaced interlocking longitudinal stringer elements is slidably affixed to the adjacent interlocking longitudinal stringer element and is positively prevented from separating from said adjacent interlocking longitudinal stringer element.

2. The longitudinal stringer type exhaust flex pipe assembly of claim 1, wherein:

said first longitudinal interlocking feature further comprises a male longitudinal interlocking feature; and said second longitudinal interlocking feature further comprises a female longitudinal interlocking feature.

3. The longitudinal stringer type exhaust flex pipe assembly of claim 2, wherein:

each of said multiple interlaced interlocking longitudinal stringer elements being affixed to only one of said two end pieces by bonding.

4. The longitudinal stringer type exhaust flex pipe assembly of claim 2, wherein:

said two end pieces of said longitudinal stringer type exhaust flex pipe assembly each having a generally cylindrical outer wall and a generally cylindrical inner reinforcement sleeve, said generally cylindrical outer wall and generally cylindrical inner reinforcement sleeve defining an annular cavity, said multiple interlaced interlocking longitudinal stringer elements being inserted into said annular cavity.

5. The longitudinal stringer type exhaust flex pipe assembly of claim 4, wherein:

said generally cylindrical inner reinforcement sleeve is further provided with a slight inwards taper near its end.

6. The longitudinal stringer type exhaust flex pipe assembly of claim 4, wherein:

said generally cylindrical outer wall is further provided with a slight outward bell near its end.

7. The longitudinal stringer type exhaust flex pipe assembly of claim 4, wherein:

each of said multiple interlaced interlocking longitudinal stringer elements is provided with a retaining feature at one end, every other interlaced interlocking longitudinal stringer element being provided with said retaining feature at the opposite end, such that said interlaced interlocking longitudinal stringer elements alternate having said retaining feature present at a given end of said flexible cylinder; and said annular cavity of each said end piece is provided with a retaining feature compatible with said retaining features in said interlaced interlocking longitudinal stringer elements.

8. The longitudinal stringer type exhaust flex pipe assembly of claim 7, wherein:

said retaining feature in each of said multiple interlaced interlocking longitudinal stringer elements further comprises a groove for a snap ring;

said retaining feature in said annular cavity further comprises a groove for a snap ring; and a snap ring aligns said groove in said multiple interlaced interlocking longitudinal stringer elements with said groove in said annular cavity.

9. The longitudinal stringer type exhaust flex pipe assembly of claim 7, wherein:

said retaining feature in each of said multiple interlaced interlocking longitudinal stringer elements further comprises a hole for a roll pin;

said retaining feature in said annular cavity further comprises a series of holes for roll pins; and roll pins align said holes in said multiple interlaced interlocking longitudinal stringer elements with said holes in said annular cavity.

10. The longitudinal stringer type exhaust flex pipe assembly of claim 4, wherein:

each of said multiple interlaced interlocking longitudinal stringer elements having a convex side and a concave side, said convex side of said multiple interlaced interlocking longitudinal stringer elements being of the same radius as the inner surface of said generally cylindrical outer wall of said end pieces; and said concave side of said multiple interlaced interlocking longitudinal stringer elements being of the same radius as the outer surface of said generally cylindrical inner reinforcement sleeve of said end pieces.

* * * * *